US005464953A

United States Patent [19]

Kim

[11] Patent Number: 5,464,953

[45] Date of Patent: Nov. 7, 1995

[54] TIMING APPARATUS FOR A PIZZA OVEN SWITCH

[76] Inventor: Chang E. Kim, 12591 Barbara Ave., Garden Grove, Calif. 92641

[21] Appl. No.: 173,059

[22] Filed: Dec. 27, 1993

[51] Int. Cl.[6] ..... H01H 43/00

[52] U.S. Cl. ..... 200/33 R; 200/38 FA; 200/39 R; 307/141

[58] Field of Search ..... 200/33 R, 35 R, 200/38 R, 41; 307/141, 141.4, 141.8

[56] References Cited

U.S. PATENT DOCUMENTS

| | | | |
|---|---|---|---|
| 2,937,247 | 5/1960 | Laviana et al. | 200/38 FA |
| 3,818,156 | 6/1974 | Augustyniak | 200/38 A X |
| 3,823,329 | 7/1974 | Crook et al. | 307/141 |
| 4,149,654 | 4/1979 | Nelson et al. | 222/70 |
| 4,456,820 | 6/1984 | Krasznai et al. | 219/398 |
| 4,464,548 | 8/1984 | Burmeister | 200/33 R |
| 4,853,501 | 8/1989 | Sung et al. | 200/38 FA |

*Primary Examiner*—J. R. Scott
*Attorney, Agent, or Firm*—Edward D. Roberts

[57] ABSTRACT

A timing apparatus including a timer, a solenoid, a toggle switch, and an adapter plate for mounting to the valve control knob of a pizza oven, the adapter plate being provided with a detent at a given point on the periphery thereof. The knob is spring biased in a rotational direction toward the "on" position on the knob. An electrical timer is provided to energize a solenoid at a preset time duration, with the solenoid rod being physically coupled to a pivotable actuating arm, the free end of which is positioned for engagement with the detent of the knob with the knob in the "off" position, the plate being retained at that position against the force of the coil spring. A toggle switch is in electrical circuit relation with the timer, with the toggle thereof physically positioned in operative relation a member projecting from the actuating arm, such that actuation of the toggle from a first position to the second under force of the projection deenergizes the circuit between the timer and the solenoid.

17 Claims, 4 Drawing Sheets

TIMING APPARATUS FOR A PIZZA OVEN SWITCH

BACKGROUND OF THE INVENTION

The background of the invention will be presented in two parts.

1. Field of the Invention

This invention relates to timing apparatus, and more particularly to a timer adapter for a commercial pizza oven.

2. Description of the Prior Art

Ovens, such as commercial pizza ovens are physically provided with a very large baking chamber and require an inordinate length of time in which to attain sufficient operating temperature for use. As a consequence, owners of pizza shops, or their employees, are forced to enter the establishments well before opening, generally a couple of hours before opening, to turn on the ovens so that the proper baking conditions are reached before the establishment is opened. This, in turn, results in extra operating cost or extra time at the shop, or both.

Timing devices are not normally provided with commercial pizza ovens, although they are prevalent in home baking devices, such as ovens, microwave ovens, or slow cooking pots.

A search of the prior art has not disclosed the timing device of this invention.

In accordance with a feature of the present invention, there is provided a new and improved timing adapter for a commercial pizza oven.

SUMMARY OF THE INVENTION

The foregoing and other objects of the invention are accomplished by providing timing apparatus including: an adapter plate for mounting to the valve control knob of a pizza oven, the adapter plate being provided with a detent at a given point on the periphery thereof; a solenoid with the rod thereof being physically coupled to a pivotable actuating arm, the free end of the actuating arm being positioned for engagement with the detent of the adapter plate; and an electrical timer for actuating the solenoid. A coil spring has one end thereof attached to the adapter plate with the other end coupled to a fixed nearby point to bias the spring and thus the control knob in a rotational direction toward the "on" position of the knob.

The adapter plate and actuating arm are positioned and dimensioned so that the detentable engagement occurs with the knob in the "off" position, the plate being retained at that position against the force of the coil spring.

Upon energizing of the solenoid at a preset time by the timer, the actuating arm disengages from the detent and the knob, by means of the spring tension, is turned to the "on" position.

A toggle switch may be placed in electrical circuit relation with the timer and solenoid, with the toggle thereof physically positioned in operative relation with a member projecting from the actuating arm, such that actuation of the toggle from a first position to the second under force of the projection deenergizes the circuit between the timer and the solenoid. This provides for minimum apparatus power dispensation as well as protection of the solenoid contacts.

It is thus an aspect of the invention to provide a timing adapter for an oven switch.

It is another aspect of the invention to provide a timing adapter for automatically turning a manually operated pizza oven switch from the "off" position to the "on" position at a preselected time.

Other objects, features and advantages of the invention will become apparent on a reading of the specification in conjunction with the drawings, wherein there is shown and described apparatus for operating a manual switch which is simple, reliable and inexpensive in manufacture, and in which like reference numerals in the drawings refer to like elements in the several views.

DESCRIPTION OF THE PREFERRED EMBODIMENT

Figure 1:
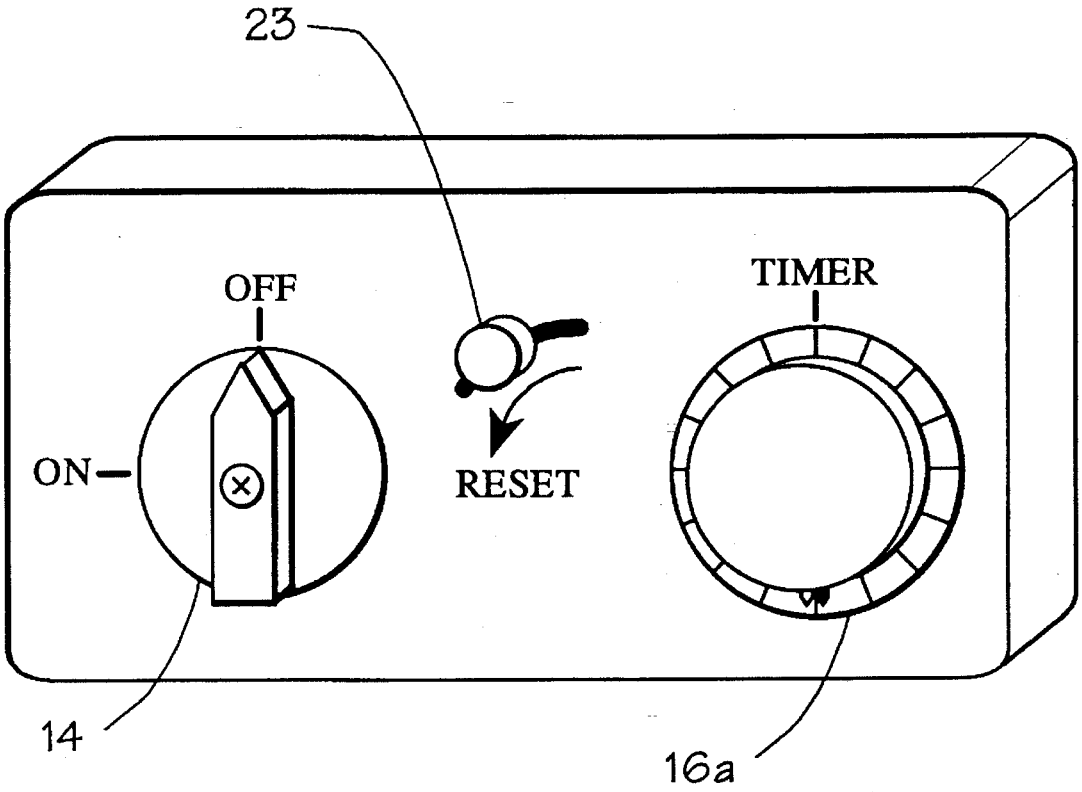
FIG. 1 is an isometric view of the pizza oven timing apparatus of the present invention.

Referring now to the drawings, there is shown a commercial pizza oven timing apparatus, generally designated 10, in partially schematic and partially diagrammatic view, FIG. 1 showing in isometric view the housing containing the pizza oven timing apparatus as is hereinafter described.

Figure 2:
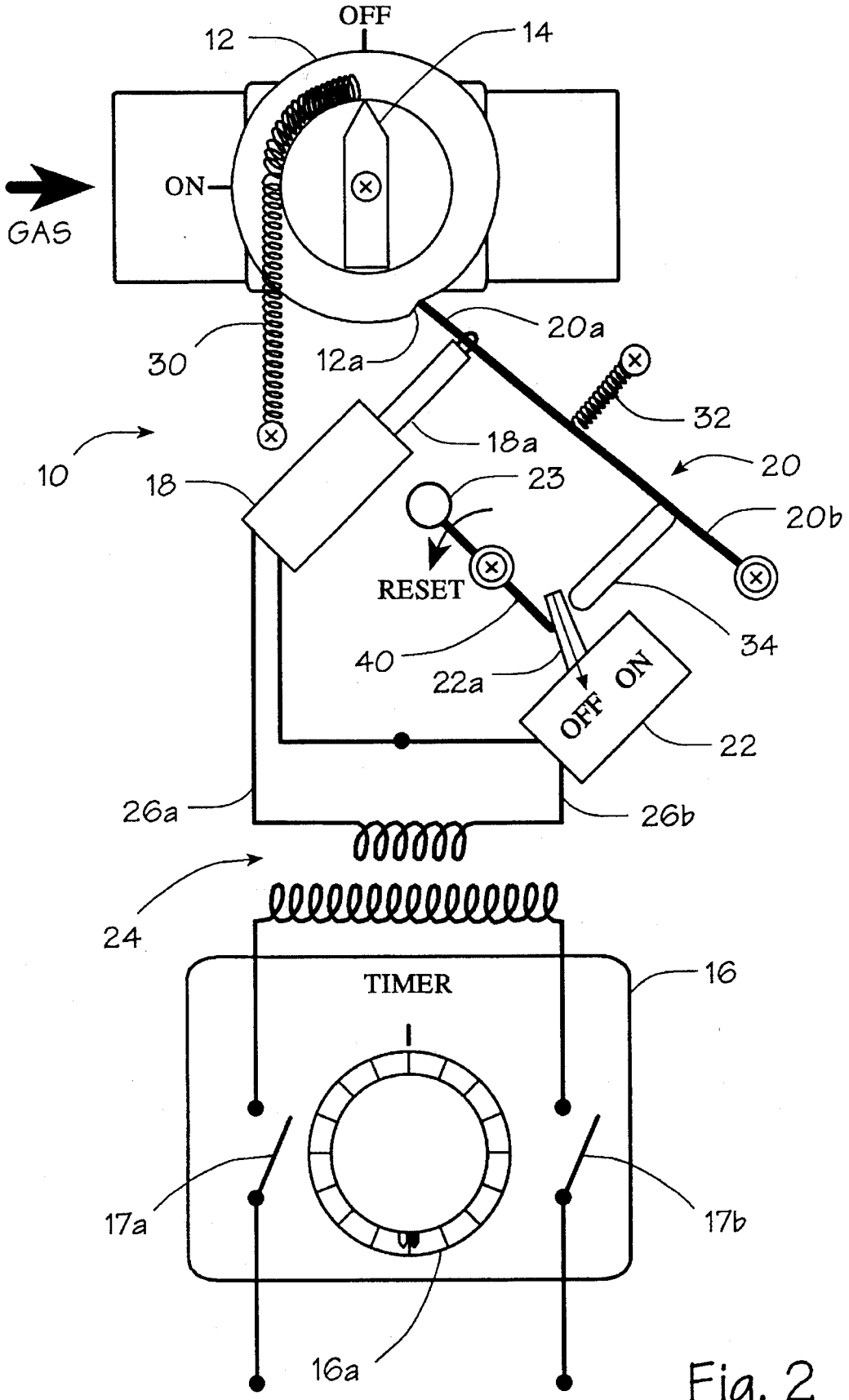
FIG. 2 is a partially schematic, partially diagrammatic view of the pizza oven timing apparatus of the invention, the apparatus being shown in its preoperative set condition for operation under control of the timer, with the oven switch "off"
Figure 3:
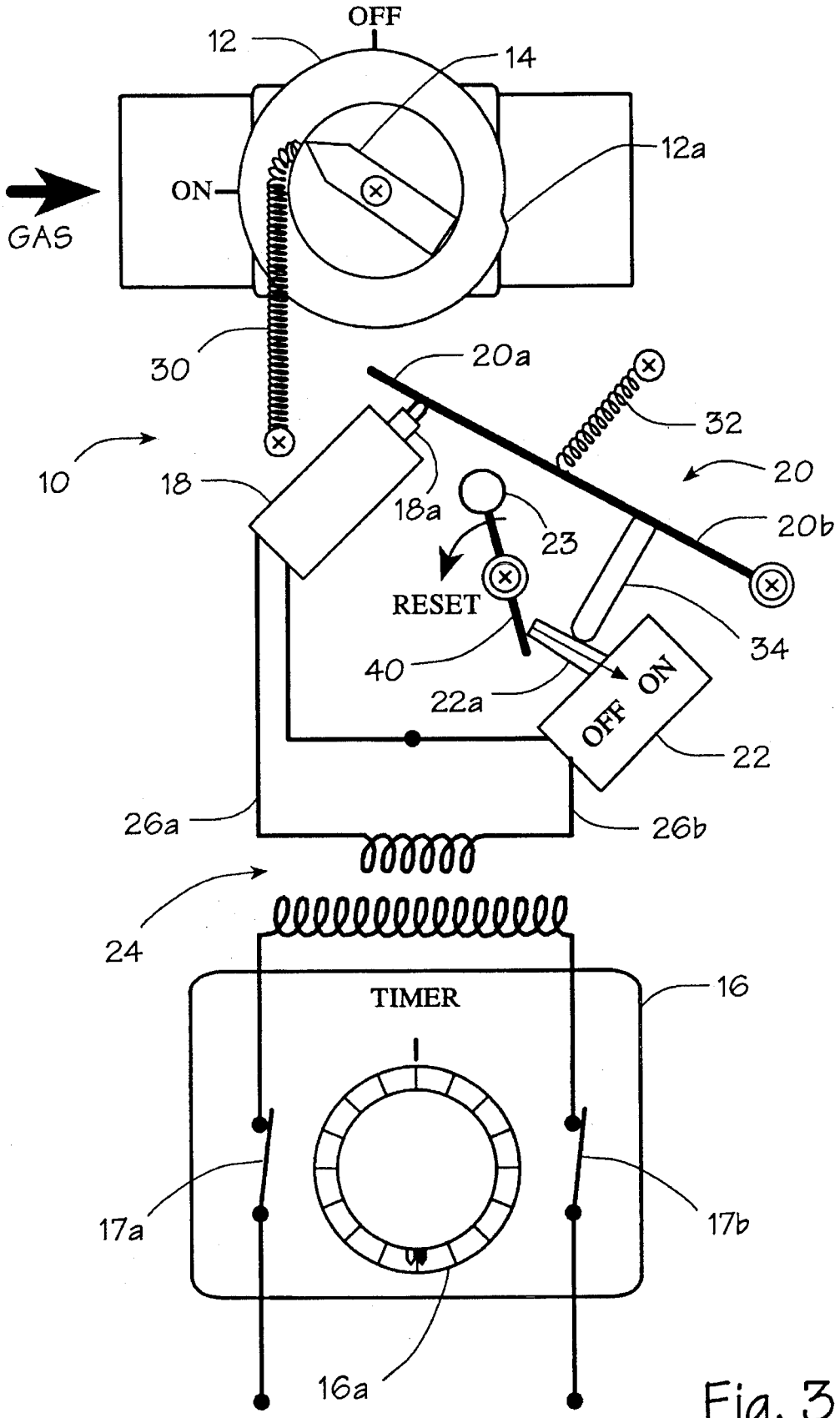
FIG. 3 is a partially schematic, partially diagrammatic view of the timing apparatus of the invention, the apparatus shown with the solenoid actuated and the oven switch being turned from the "off" to the "on" position.
Figure 4:
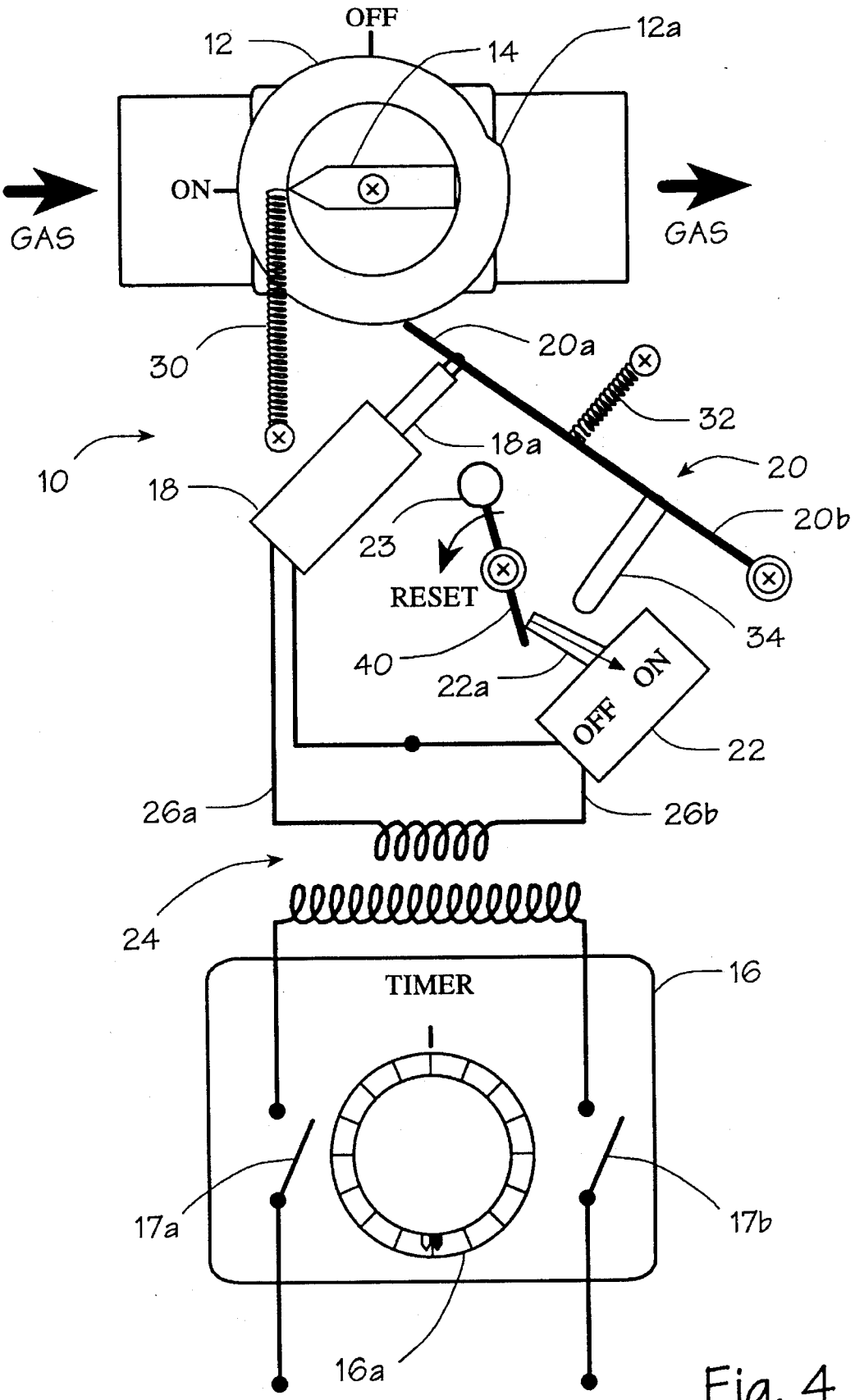
FIG. 4 is a partially schematic, partially diagrammatic view of the timing apparatus of the invention, the apparatus shown in its actuated condition after timing out of the timer, the oven switch now in the "on" position.

As more clearly shown in FIGS. 2–4, the apparatus 10 includes, as component parts: an adapter disc or plate 12 configured for attachment to the control knob 14 of the oven; a timer 16; a solenoid 18; an actuating arm assembly, generally designated 20; a lever or toggle switch 22; and a toggle switch reset mechanism, generally designated 23.

The existing valve of the oven includes a valve control knob 14, which is removed and provided with the adapter plate 12 for concurrent rotation with the control knob 14. The adapter plate 12 is generally disc shaped and formed of metal, or any suitable material, and may have a centrally located generally rectangular slot configured for fitting over the rectangular configuration of the valve stem.

Alternatively, the plate 12 may be physically affixed to the rear surface of the control knob 14 by any convenient method. The periphery of the disc or plate 12 is provided with a detent portion **12*a* for cooperative engagement with the free end of the actuating arm 20, as will be hereinafter described. The plate has affixed thereto one end of a coil spring 30, the other end of which is physically attached to some portion of the apparatus in proximity to the knob 14, with the spring bias being in a counterclockwise direction as viewed in the drawings, that is, toward the "on" position of rotation of the knob 14**.

The solenoid 18 is physically mounted in proximity to the plate 12, the solenoid armature or rod **18*a* of the solenoid being physically attached to the free end 20*a* of a pivotable actuating arm 20, the other end 20*b* the actuating arm being pivotally attached to some physical part of the apparatus in proximity to the adapter disc or plate 12**.

The actuating arm 20 is of a length sufficient for the free end 20*a* thereof to detentingly engage the detent 12*a* of the plate 12. A coil spring 32 has one end thereof coupled adjacent the midpoint of the arm 20, with the other end of spring 32 physically attached to some stationary part of the adjacent fixture or apparatus, with the coil away from the solenoid 32.

On the opposite surface of the arm 20, a projection 34 is affixed thereto, extending into proximate interoperative engagement with one side of the lever or toggle 22*a* of the toggle switch 22. The opposite side of the toggle 22*a* is proximate the free end of a pivotable reset lever, generally designated 40, which is manually pivotable in a counterclockwise manner to urge the toggle switch to the right as viewed in the drawings, this pivoting actuating the switch to its "on" position. Correspondingly, contact of the projection 34 with the toggle 22*a* actuates the switch 22 to its "off" position.

The timer 16 may be any conventional timer presettable to operate at a given time for a settable time duration, and which includes an electrical switch mechanism, shown as a double pole, double throw switch (17*a*, 17*b*), for switchable connection to a suitable source of power, such as a 110 volt outlet.

The circuit may include a step down isolation transformer 24 for stepping down the supply voltage to a lower voltage at the input terminals of the solenoid, such as twelve or twenty-four volts. Correspondingly, the solenoid 18 to be used is a solenoid which operates at the lower voltage. The output terminal 24*a* of transformer 24 is connected to one lead of the solenoid 18, while the other output terminal 24*b* is connected to one lead of a level or toggle switch 22, the other lead of switch 22 being connected to the other input of the solenoid 18.

In other words, the switch 22 is in series circuit relation between the solenoid 18 and the output terminals 24*a*, 24*b* of the transformer 24, and serves to deenergize the solenoid 18 after actuation of the apparatus 10 as will be hereinafter described.

Having described the physical and electrical arrangement, the operation of the timing apparatus 10 will now be described.

As shown in FIG. 2, the apparatus 10 has been set for operation, that is, the control knob 16*a* of timer 16 has been rotated for actuation at some present future time, with the contacts 17*a* and 17*b* of timer 16 in the open position, thus solenoid 18 is not actuated and the rod 18*a* is fully extended. Valve control knob 14 is in its "off" position with, as shown by the single dark arrow at the left end thereof, no gas flowing through the valve 50.

The free end 20*a* of the actuating arm is detentingly engaged by the detent 12*a* of the adapter disc or plate 12. The bias of spring 32 urges the distal or free end 20*a* of actuating arm 20 into proximate or abutting relation with the periphery of adapter disc or plate 12.

The reset mechanism 40 has been pivoted counterclockwise to urge the toggle 22*a* of the switch 22 to its "on" position, and thus in proximate or abutting relation with the end of projection 34 of actuating arm 20. In this "on" position, switch 22 is in position to provide power to the electrical components upon actuation of the timer.

Referring now to FIG. 3, upon the timer 16 reaching its preset time, the contacts 17*a*, 17*b*, close to provide power to the electrical circuit. With the switch 22 "on" a series connection is made from the output terminals on the timer to the leads of solenoid 18, whereupon the solenoid rod 18*a* is retracted fully, releasing the end 20*a* of the arm 20 from within detent 12*a* of plate 12, thereby allowing the tension of spring 30 to cause valve control knob 14 to rotate counterclockwise to the "on" position to allow gas to flow through the valve 50.

As solenoid 18 is actuated and rod 18*a* is retracted, the actuating arm 20 is pivoted counterclockwise against the force of its spring 32, whereupon the-projection 34 contacts the toggle 22*a* of switch 22, urging it to the left, or "off" position. This serves to quickly open the electrical circuit after the gas valve is turned on, to remove power from the solenoid, thus providing protection to the solenoid.

FIG. 4 shows the apparatus 10 with the components in their positions after valve control knob 14 has been actuated to the "on" position and, as shown by the dark arrows, gas is flowing through the valve 50. Power has been removed from the solenoid 18 by opening of switch 22 thus allowing the rod 18*a* to extend partially to the position shown under the retraction force of spring 32. The preset "on" time of the timer 16 has elapsed and the timer 16 is again "off". The toggle switch 22 is in the "off" position and reset mechanism 23 is in position to be rotated counterclockwise to reset switch 22 to the "on" position when desired.

Alternatively, if it is not desired to deenergize the solenoid after the oven is turned on, neither projection 34, toggle switch 22, nor reset lever 40 is necessary. Further, if it is not desired to provide a lower supply voltage to the solenoid, then step-down transformer 24 is not necessary.

In accordance with the present invention there has been shown and described an apparatus 10 which can be utilized with a conventional commercial pizza oven for setting a predetermined time at which the oven will be turned on, with the timing apparatus 10 being economically fabricated and requiring no specially constructed parts.

While a preferred embodiment has been shown and described it is to be understood that other modifications may be made within the spirit and scope of the invention.

For instance, inclusion of the transformer 24 is optional depending upon whether it is desired to use lower voltage electrical components. Additionally, inclusion of the switch 22, projection 34 and reset mechanism 23 is optioal depending upon whether it is desired to deenergize the electrical circuit shortly after switch 14 is rotated to the "on" position.

What is claimed is:

1. Control apparatus for a device having a control knob rotatable between an "on" and "off" position, said apparatus comprising:

a disc member rotatable with said control knob, said disc member having a detent in the periphery thereof;

means for biasing said control knob to its "on" position;

an arm pivotable about a fixed end and having the free end thereof engageable with said detent only with said control knob rotated to its "off" position;

a solenoid having the armature thereof mechanically coupled to pivot said arm; and an electrically operated timer in circuit relation with said solenoid, said timer being presettable to energize said solenoid at a predetermined time for a given time duration, energization of said solenoid pivoting said arm about its fixed end in a direction to forcibly disengage the free end of said arm from the detent in said disc member, thereby enabling rotation of said control knob to its "on" position under force of said biasing means.

2. The apparatus of claim 1 further including electrical switch means in circuit relation with said solenoid and said timer for deenergizing the power to said solenoid upon release of said arm from said detent means.

3. The apparatus of claim 1 wherein said switch means includes a toggle operable between first and second positions, said switch means being normally in said first position with said free end of said arm in engagement with said detent, and wherein said arm includes means for operative engagement with said toggle to actuate said toggle to its second position to deenergize the power to said solenoid upon release of said arm from said detent means.

4. The apparatus of claim 1 wherein the pivoting of said arm is retractably biased against the force of the solenoid armature.

5. The apparatus of claim 3 further including manually operable means for resetting said toggle to said first position.

6. Control apparatus for an oven comprising;

control knob means rotatable between an "on" and "off" position;

means for biasing said control knob means to its "on" position;

means having a portion thereof matingly engageable with said control knob means for holding said control knob rotated to its "off" position against the force of said biasing means;

solenoid means having its armature mechanically coupled to said holding means; and an electrically operated timer in circuit relation with said solenoid means, said timer being presettable to energize said solenoid means at a predetermined time for a given time duration, energization of said solenoid means releasing said holding means for enabling rotation of said control knob means to its "on" position under force of said biasing means.

7. The apparatus of claim 6 wherein said control knob means includes a detent and said holding means includes an arm member configured for detentingly engaging said detent.

8. The apparatus of claim 7 wherein said control knob means includes a control knob and a disc member rotatable therewith, and said detent is formed in said disc member.

9. The apparatus of claim 7 wherein said arm member is biased against the force of said solenoid means.

10. The apparatus of claim 6 wherein further including a switch means in electrical circuit relation between said solenoid means and said timer.

11. The apparatus of claim 10 wherein said switch means includes a toggle operable between first and second positions, said switch means being normally in said first position with said end of said arm in engagement with said detent, and wherein said holding means includes means for operative engagement with said toggle to actuate said toggle to its second position to deenergize the power to said solenoid means upon release of said holding means.

12. The apparatus of claim 11 wherein said control knob means includes a detent and said holding means includes an arm member configured for detentingly engaging said detent.

13. The apparatus of claim 12 wherein said control knob means includes a control knob and a metallic disc member rotatable therewith, and said detent is formed in said disc member.

14. The apparatus of claim 13 wherein said arm member is biased against the force of said solenoid means.

15. Control apparatus for a device having a control knob rotatable between an "on" and "off" position, said apparatus comprising:

a rotatable member in rotatable communication with said control knob;

means attached to said rotatable member for biasing said control knob to its "on" position;

bias release means engageable with said rotatable member for selectively constraining said rotatable member only with said control knob rotated to its "off" position;

a solenoid having the armature thereof mechanically coupled to said bias release means; and an electrically operated timer in circuit relation with said solenoid, said timer being presettable to energize said solenoid at a predetermined time for a given time duration, energization of said solenoid removing constraint of said rotatable member by said bias release means thereby enabling rotation of said rotatable member to thereby turn said control knob to its "on" position under force of said biasing means.

16. The apparatus of claim 15 further including electrical switch means in circuit relation with said solenoid and said timer operable by said bias release means to deenergize the power to said solenoid upon release of constraint of said rotatable member.

17. Control apparatus for operating a manual switch, the apparatus comprising:

rotary mechanism mounted in rotatable communication with said manual switch;

spring means for providing tension for rotating said rotary mechanism;

a solenoid for controlling said spring means;

a timer in electrical communication with said solenoid whereby upon activation of said solenoid by said timer, spring tension is provided from said spring to said rotary mechanism to operate said manual switch; and switch means for interrupting the electrical circuit containing said solenoid after said spring tension has been applied to said rotary mechanism.

* * * * *

UNITED STATES PATENT AND TRADEMARK OFFICE

CERTIFICATE OF CORRECTION

PATENT NO. : 5,464,953

DATED : November 7, 1995

INVENTOR(S) : Chang D. Kim

It is certified that error appears in the above-identified patent and that said Letters Patent is hereby corrected as shown below:

On the title page, item [76] Inventor: "Chang E. Kim" should read --Chang D. Kim--

Signed and Sealed this

Twenty-seventh Day of February, 1996

*Attest:*

Bruce Lehman

BRUCE LEHMAN

*Attesting Officer*

*Commissioner of Patents and Trademarks*